US012747396B2

(12) United States Patent
Khademi et al.

(10) Patent No.: US 12,747,396 B2
(45) Date of Patent: Sep. 29, 2026

(54) PROCESS AND SYSTEM FOR CONVERTING SOLID CARBON-BASED FEEDSTOCKS TO HYDROCARBONS AND COKE UTILIZING A COKE DRUM

(71) Applicant: Chevron U.S.A. Inc., San Ramon, CA (US)

(72) Inventors: Mahdi Khademi, Los Angeles, CA (US); Anshu Anshumali, Mobile, AL (US); Hye-Kyung Timken, Albany, CA (US)

(73) Assignee: CHEVRON U.S.A. INC., San Ramon, CA (US)

( * ) Notice: Subject to any disclaimer, the term of this patent is extended or adjusted under 35 U.S.C. 154(b) by 3 days.

(21) Appl. No.: 18/936,128

(22) Filed: Nov. 4, 2024

(65) Prior Publication Data

US 2026/0125601 A1 May 7, 2026

(51) Int. Cl.
*C10G 1/10* (2006.01)

(52) U.S. Cl.
CPC ..... *C10G 1/10* (2013.01); *C10G 2300/1003* (2013.01); *C10G 2300/4006* (2013.01); *C10G 2400/20* (2013.01); *C10G 2400/22* (2013.01); *C10G 2400/30* (2013.01)

(58) Field of Classification Search
CPC ..... C10G 1/10; C10G 2300/1003; C10G 2300/4006; C10G 2400/20
See application file for complete search history.

(56) References Cited

U.S. PATENT DOCUMENTS 3,901,951 A * 8/1975 Nishizaki ..... C10B 49/10 521/40.5
4,168,224 A * 9/1979 Jansma ..... C10B 39/06 202/241

(Continued)

FOREIGN PATENT DOCUMENTS

EP 3795656 A1 3/2021
RU 2215771 C1 11/2003

(Continued)

OTHER PUBLICATIONS

PCT/US2025/040638, International Search Report, Nov. 12, 2025, 5 pages.

*Primary Examiner* — Tam M Nguyen
(74) *Attorney, Agent, or Firm* — Michael E. Carmen; Terrence M. Flaherty

(57) ABSTRACT

A process includes receiving, in an unheated coke drum, a feedstock comprising a solid carbon-based material, heating the unheated coke drum and the feedstock comprising the solid carbon-based material to a first temperature to form a heated feedstock comprising the solid carbon-based material in a semi-solid state or a melted state in a heated coke drum, and processing the heated feedstock comprising the solid carbon-based material in the semi-solid state or the melted state in the heated coke drum with a heated petroleum residue-containing feedstock at a second temperature and under reaction conditions to convert at least a portion of the heated feedstock comprising the solid carbon-based material in the semi-solid state or the melted state to a product stream including a gas phase including hydrocarbons and hydrogen, and coke.

20 Claims, 3 Drawing Sheets

(56) References Cited

U.S. PATENT DOCUMENTS

| | | | | |
|---|---|---|---|---|
| 4,737,261 | A * | 4/1988 | Hoover | C10B 55/00 208/50 |
| 6,881,303 | B2 * | 4/2005 | Inoue | C10G 1/10 201/23 |
| 10,968,396 | B1 * | 4/2021 | Koseoglu | C10G 1/10 |
| 11,421,159 | B2 * | 8/2022 | Pradeep | C10B 53/07 |
| 2011/0203968 | A1 * | 8/2011 | Scheirs | C10G 1/10 208/15 |
| 2022/0372375 | A1 * | 11/2022 | Patel | C10B 55/10 |
| 2023/0047205 | A1 * | 2/2023 | Siddiqui | C10G 9/005 |
| 2025/0354075 | A1 * | 11/2025 | Patel | C10G 1/10 |

FOREIGN PATENT DOCUMENTS

| | | | | |
|---|---|---|---|---|
| WO | 2013037509 | A1 | 3/2013 | |
| WO | WO-2021091724 | A1 * | 5/2021 | C10B 49/10 |
| WO | 2023173007 | A1 | 9/2023 | |

* cited by examiner

Thermal Stability of Polyethylene, Polypropylene and Polyvinyl Chloride by Thermal Gravimetric Analysis

PROCESS AND SYSTEM FOR CONVERTING SOLID CARBON-BASED FEEDSTOCKS TO HYDROCARBONS AND COKE UTILIZING A COKE DRUM

BACKGROUND

There is an increasing interest in alternative feedstocks for replacing at least partly crude oil, in the production of hydrocarbons suitable as fuels or fuel components, for example, as transportation fuels, or compatible with fuels. Biofuels are typically manufactured from feedstock originating from renewable sources including oils and fats obtained from plants, animals, algal materials, fish, and various waste streams, side streams and sewage sludge. These feedstocks, particularly the various waste streams and side streams, contain varying amounts of contaminants, such as gums, organic chlorine compounds, phospholipids and other phosphorus compounds, metals and metal compounds, and residual soaps, which are, for example, deleterious to converting catalysts.

In addition, the world has seen extremely rapid growth of plastics production. According to Plastics Europe Market Research Group, the world plastics production was 335 million tons in 2016, 348 million tons in 2017, 359 million tons in 2018, and 367 million tons in 2020. According to the United Nations Environment Programme (UNEP), plastic pollution is on course to double by 2030, with significant consequences for health, the economy, biodiversity, and the climate. This underscores the urgent need for global action to reduce plastic waste and transition to more sustainable practices.

Single use waste plastic has become an increasingly important environmental issue. At the moment, there appear to be few options for recovering waste plastics such as, for example, polyethylene and polypropylene waste plastics, to value-added chemical and fuel products. Presently, only a small amount of polyethylene/polypropylene waste plastic is recycled via chemical recycling, where recycled and cleaned plastic pellets are pyrolyzed in a pyrolysis unit to make fuels (naphtha, diesel), steam cracker feed or slack wax. The majority, greater than 80%, is incinerated, land filled or discarded.

Currently there is no viable technology to convert general types of carbon-based materials including thermosets, polycyclic compounds and very heavy hydrocarbons that cannot be melted or dissolved in typical solutions in the industry and thereafter processed.

SUMMARY

In accordance with an illustrative embodiment, a process comprises:

receiving, in a first unheated coke drum, a feedstock comprising a solid carbon-based material, heating the first unheated coke drum and the feedstock comprising the solid carbon-based material to a first temperature to form a heated feedstock comprising the solid carbon-based material in a semi-solid state or a melted state in a first heated coke drum, and processing the heated feedstock comprising the solid carbon-based material in the semi-solid state or the melted state in the first heated coke drum with a heated petroleum residue-containing feedstock at a second temperature and under reaction conditions to convert at least a portion of the heated feedstock comprising the solid carbon-based material in the semi-solid state or the melted state to a product stream comprising a gas phase comprising hydrocarbons and hydrogen, and coke.

In accordance with another illustrative embodiment, a system comprises:

an unheated coke drum configured to receive a feedstock comprising a solid carbon-based material, and one or more heating elements, associated with the unheated coke drum, and configured to heat the unheated coke drum and the feedstock comprising the solid carbon-based material to a first temperature to form a heated feedstock comprising the solid carbon-based material in a semi-solid state or a melted state in a heated coke drum, wherein the heated coke drum is configured to process the heated feedstock comprising the solid carbon-based material in the semi-solid state or the melted state with a heated petroleum residue-containing feedstock at a second temperature and under reaction conditions to convert at least a portion of the heated feedstock comprising the solid carbon-based material in the semi-solid state or the melted state to a product stream comprising a gas phase comprising hydrocarbons and hydrogen, and coke.

BRIEF DESCRIPTION OF THE DRAWINGS

In combination with the accompanying drawing and with reference to the following detailed description, the features, advantages, and other aspects of the implementations of the present disclosure will become more apparent, and several implementations of the present disclosure are illustrated herein by way of example but not limitation. In the accompanying drawings.

DETAILED DESCRIPTION

Figure 1A:
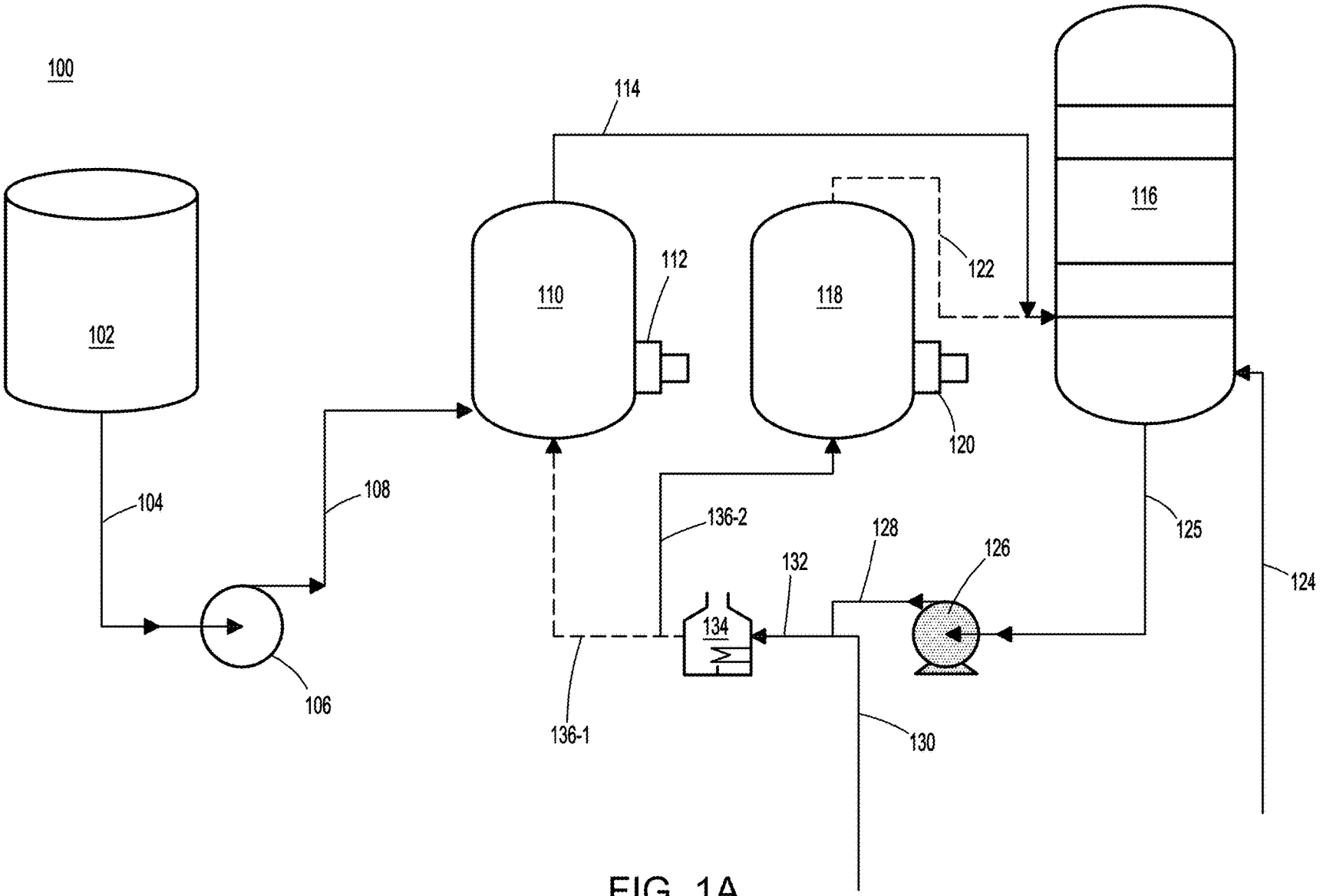
FIG. 1A illustrates a schematic diagram of a process and system for converting one or more feedstocks comprising a solid carbon-based material to a product stream comprising a gas phase comprising hydrocarbons and hydrogen, and coke utilizing an unheated coke drum, according to an illustrative embodiment.

Various illustrative embodiments described herein are directed to processes and systems for converting a feedstock comprising a solid carbon-based material to chemicals and/or fuels utilizing an unheated coke drum. As mentioned above, waste plastic has become an increasingly important environmental issue. Plastics are inexpensive, easy to mold, and lightweight with many commercial applications. Once the plastic products have outlived their useful lives, they are generally sent to waste disposal such as landfill sites, adding to serious environmental problems, like land, water, and air pollution or recycled by reprocessing the waste into raw material for reuse. In addition, the disposal costs for the post-industrial plastic waste poses an extra burden on processors and manufacturers. Also, there is the consideration that a high demand to produce more virgin resin material places a burden on an already limited and depleting natural resource.

Delayed coking is a semi-batch process that feeds heavy hydrocarbons including, for example, hydrocarbons with high molecular weight and high boiling points. The coking process generally includes isolating the coke drum from the atmosphere, removing air/oxygen with steam or other methods, preheating the coke drum using steam and hydrocarbon vapor, and then feeding the heated coke drum. After the feeding and thermal cracking cycle ends, the coke drum is stripped with vapors, including steam, cooled by means of steam and water to minimize volatile hydrocarbons in the vapor space, and then opened to the atmosphere for drilling and cutting, as well as releasing coke to the storage pit for dewatering and transportation.

Present processes introduce the solid waste plastics or other alternative solid carbon-based feeds that can melt or dissolve as a liquid or solid into the heated coke drum during the delayed coking process while the coke drum is feeding. However, problems associated with the present heat transfer methods to move solid waste plastics or other alternative solid carbon-based feeds into heated coke drums include fouling issues and plugging, due to, for example, the type of solid waste plastic being used. Fouling decreases energy efficiency and severe fouling can cause safety and reliability challenges in coker operations. Plugging in this case is considered the blockage of the coke drum inlet or outlet by solid deposits or agglomerates, which impedes the flow, heat transfer and operation of the coker.

The illustrative embodiments described herein overcome these and other drawbacks by providing processes and systems for converting one or more feedstocks comprising a solid carbon-based material to chemicals and/or fuels utilizing one or more unheated coke drums. Among other factors, it has been found that utilizing an unheated coke drum can mitigate fouling and plugging issues in a system of the present disclosure thereby allowing for a more consistent flow of the one or more feedstocks comprising a solid carbon-based material into the one or more unheated coke drums. Thus, the use of unheated coke drums in processing the one or more feedstocks comprising a solid carbon-based material according to the present disclosure can improve the overall hydrocarbon yield obtained from processing the one or more feedstocks comprising a solid carbon-based material. In some instances, the hydrocarbon yield can be as much as about 10% or more higher than the normal coker yields with removal of solvent/diluent.

Definitions

As used in this disclosure the word "comprises" or "comprising" is intended as an open-ended transition meaning the inclusion of the named elements, but not necessarily excluding other unnamed elements. The phrase "consists essentially of" or "consisting essentially of" is intended to mean the exclusion of other elements of any essential significance to the composition. The phrase "consisting of" or "consists of" is intended as a transition meaning the exclusion of all but the recited elements with the exception of only minor traces of impurities.

The terms "a," "an," and "the" are intended to include plural alternatives, e.g., at least one. The terms "including," "with," and "having," as used herein, are defined as comprising (i.e., open language), unless specified otherwise.

Various numerical ranges are disclosed herein. When Applicant discloses or claims a range of any type, Applicant's intent is to disclose or claim individually each possible number that such a range could reasonably encompass, including end points of the range as well as any sub-ranges and combinations of sub-ranges encompassed therein, unless otherwise specified. For example, all numerical end points of ranges disclosed herein are approximate, unless excluded by proviso.

Values or ranges may be expressed herein as "about," from "about" one particular value, and/or to "about" another particular value. When such values or ranges are expressed, other embodiments disclosed include the specific value recited, from the one particular value, and/or to the other particular value. Similarly, when values are expressed as approximations, by use of the antecedent "about," it will be understood that the particular value forms another embodiment. It will be further understood that there are a number of values disclosed therein, and that each value is also herein disclosed as "about" that particular value in addition to the value itself. In another aspect, use of the term "about" means ±20% of the stated value, ±15% of the stated value, ±10% of the stated value, ±5% of the stated value, ±3% of the stated value, or ±1% of the stated value.

The terms "wt. %", "vol. %" or "mol. %" refers to a weight, volume, or molar percentage of a component, respectively, based on the total weight, the total volume, or the total moles of material that includes the component. In a non-limiting example, 10 moles of component in 100 moles of the material are 10 mol. % of component.

The term "continuous" as used herein shall be understood to mean a system that operates without interruption or cessation for a period of time, such as where reactant(s) and catalyst(s) are continually fed into a reaction zone and products are continually or regularly withdrawn without stopping the reaction in the reaction zone.

The term "virgin" denotes the newly produced materials and/or objects prior to their first use, which have not already been recycled.

The term "municipal solid waste" as used herein refers to nonliquid waste that comes from homes, institutions, and small businesses.

The term "waste plastic" as used herein refers to any post-industrial (or pre-consumer) and post-consumer plastics, such as, for example, one or more polyesters, one or more polyolefins (PO), polyvinyl chloride (PVC), polycarbonate (PC), poly methyl methacrylate (PMMA) and/or polystyrene (PS).

The term "post-industrial plastic" (or "pre-consumer" plastic) as used herein includes all manufactured recyclable organic plastics that are not post-consumer plastics, such as a material that has been created or processed by a manufacturer and has not been used for its intended application, has not been sold to the end use customer, or has been discarded or transferred by a manufacturer or any other entity engaged in the sale or disposal of the material.

The term "post-consumer plastic" as used herein refers to a plastic that has been used at least once for its intended application for any duration of time regardless of wear, has been sold to an end use customer, or has been discarded into a recycle bin by any person or entity other than a manufacturer or business engaged in the manufacture or sale of the material. Examples of post-industrial or pre-consumer plastics include rework, regrind, scrap, trim, out of specification materials, and finished materials transferred from a manufacturer to any downstream customer (e.g., manufacturer to wholesaler to distributor) but not yet used or sold to the end use customer.

The term "upgrade" or "upgrading" generally means to improve quality and/or properties of a stream and is meant to include physical and/or chemical changes to a stream. Further, upgrading is intended to encompass removing impurities (e.g., heteroatoms, metals, etc.) from, for example, a hydrocarbon stream, converting a portion of the hydrocarbons into shorter chain length hydrocarbons, cleaving single ring or multi-ring aromatic compounds present in a hydrocarbon stream, and/or reducing viscosity of a hydrocarbon stream or converting to higher value products.

Applicant reserves the right to proviso out or exclude any individual members of any such group of values or ranges, including any sub-ranges or combinations of sub-ranges within the group, that can be claimed according to a range or in any similar manner, if for any reason Applicant chooses to claim less than the full measure of the disclosure, for example, to account for a reference that Applicant may be unaware of at the time of the filing of the application. Further, Applicant reserves the right to proviso out or exclude any members of a claimed group.

Although any processes and materials similar or equivalent to those described herein can be used in the practice or testing of the illustrative embodiments described herein, the typical processes and materials are herein described.

Figure 1B:
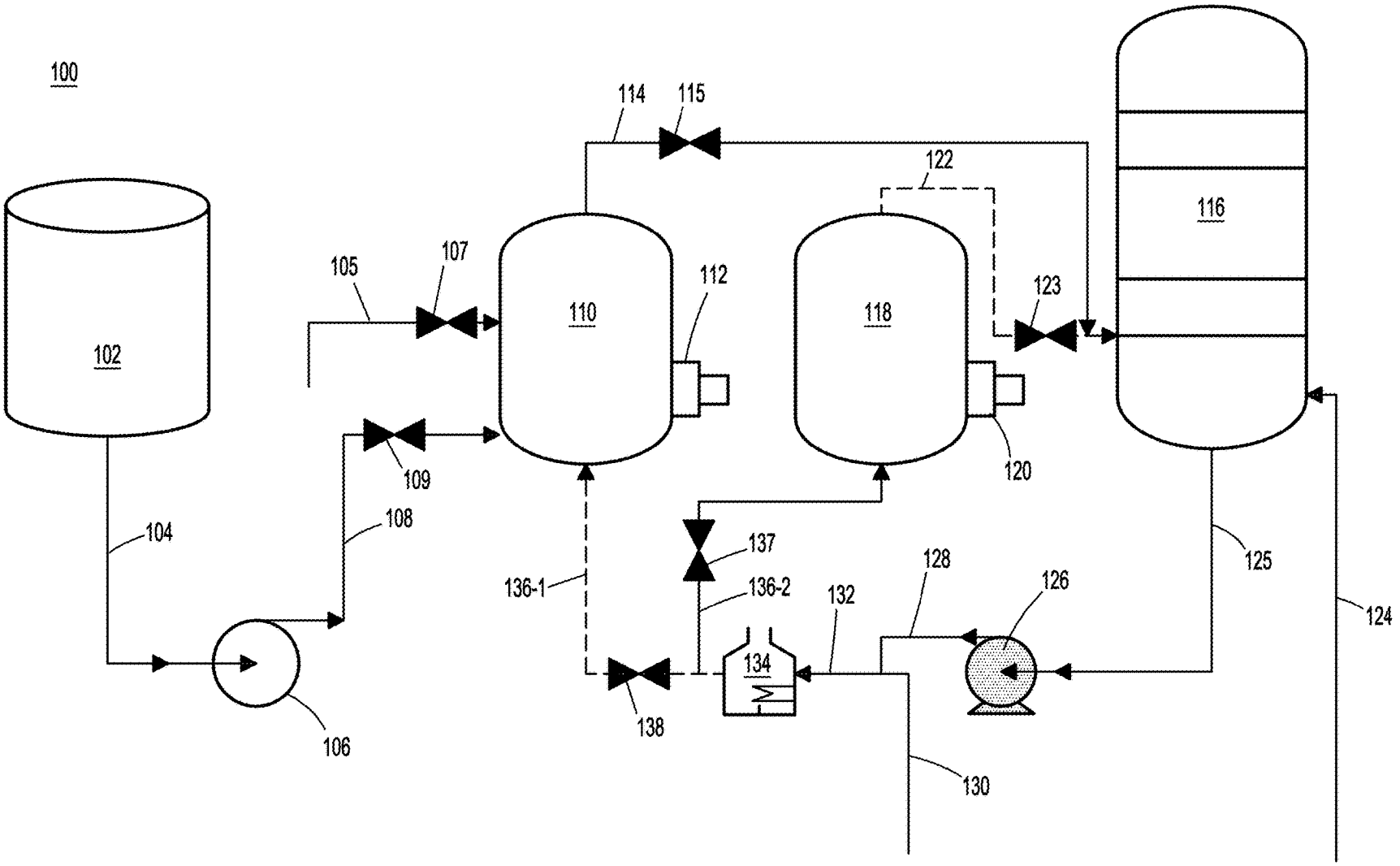
FIG. 1B illustrates a schematic diagram of a process and system for converting one or more feedstocks comprising a solid carbon-based material to a product stream comprising a gas phase comprising hydrocarbons and hydrogen, and coke utilizing an unheated coke drum, according to an illustrative embodiment.

The illustrative embodiments of the present disclosure will be specifically described below with reference to the accompanying drawings. For the purpose of clarity, some steps leading up to the conversion of the one or more solid carbon-based feedstocks as illustrated in FIGS. 1A and 1B are omitted. In other words, one or more well-known processing steps which are not illustrated but are well-known to those of ordinary skill in the art have not been included in the figures. This is not intended to be interpreted as a limitation of any particular embodiment, or illustration, or scope of the claims.

Referring now to the drawings in more detail, FIGS. 1A and 1B illustrate a process and system including a storage unit, a first coke drum, a second coke drum and a fractionator for separating a product stream including gases and hydrocarbons from the coke drums and for recovering one or more liquid distillate products and heavy bottoms. As will be appreciated by one of skill in the art, the components of the system can be in fluid communication with each other through any suitable conduits (e.g., pipes, streams, etc.). It is to be understood that the process and system including at least the storage unit, the first coke drum, the second coke drum and the fractionator is not limited to the configuration of the embodiments shown in FIGS. 1A and 1B, and other configurations are contemplated herein. In addition, while the exemplary embodiments are described in FIGS. 1A and 1B with a process and system having a first coke drum and a second drum, it is to be appreciated that any number of coke drums arranged in any series or parallel are contemplated herein. For ease of understanding, specific examples mentioned in the following description are all illustrative and are not used to limit the protection scope of the present disclosure.

FIGS. 1A and 1B show a system 100 including a storage unit 102 for storing one or more feedstocks comprising a solid carbon-based material. Storage unit 102 can be any conventional storage unit for storing the one or more feedstocks comprising a solid carbon-based material. For example, storage unit 102 can be a silo designed for efficient discharge of the one or more feedstocks comprising a solid carbon-based material.

Suitable feedstocks comprising a solid carbon-based material include, for example, feedstocks having a carbon content of at least about 75 weight percent. In some embodiments, feedstocks comprising a solid carbon-based material can have a carbon content of about 75 weight percent to about 99 weight percent. In some embodiments, feedstocks comprising a solid carbon-based material can have a carbon content of about 80 weight percent to about 99 weight percent. In some embodiments, feedstocks comprising a solid carbon-based material can have a carbon content of about 90 weight percent to about 98 weight percent.

In an illustrative embodiment, the form of the one or more feedstocks comprising a solid carbon-based material can include any of the forms of articles, products, materials, or portions thereof. For example, a portion of an article, product, material, or portions thereof can take the form of sheets, extruded shapes, moldings, films, carpet, laminates, foam pieces, chips, flakes, particles, agglomerates, briquettes, elastomers, powders, shredded pieces, long strips, randomly shaped pieces having a wide variety of shapes, or any other form other than the original form of the article and adapted to feed to the one or more coke drums discussed hereinbelow.

In an illustrative embodiment, as may be combined with one or more of the preceding paragraphs, the one or more feedstocks comprising a solid carbon-based material can be in the form of solid particles, such as chips, flakes, or a powder. In another embodiment, the one or more feedstocks comprising a solid carbon-based material may comprise particulates such as, for example, shredded plastic particles, chopped plastic particles, or plastic pellets.

In an illustrative embodiment, as may be combined with one or more of the preceding paragraphs, the one or more feedstocks comprising a solid carbon-based material can be derived from sustainable renewables resources such as, for example, plants or algae.

In some embodiments, suitable one or more feedstocks comprising a solid carbon-based material include, for example, polymers, biomass and the like.

A polymer is a carbon-based (at least 50 mass % C) material chiefly made up of repeating units and having a number average molecular weight of at least about 100, or greater than about 1000 or greater than about 10,000. Suitable polymers include, for example, thermoplastic polymers such as, for example, polyethylene, polypropylene, polyesters, polyethylene terephthalate (PET), acrylonitrile-butadiene-styrene (ABS) copolymers, polyamide, polyurethane, polyethers, polycarbonates, poly(oxides), poly(sulfides), polyarylates, polyetherketones, polyetherimides, polysulfones, polyurethanes, polyvinyl alcohols, and polymers produced by polymerization of monomers, such as, for example, dienes, olefins, styrenes, acrylates, acrylonitrile, methacrylates, methacrylonitrile, diacids and diols, lactones, diacids and diamines, lactams, vinyl halides, vinyl esters, block copolymers thereof, and alloys thereof, thermoset polymers such as, for example, epoxy resins; phenolic resins; melamine resins; alkyd resins; vinyl ester resins; unsaturated polyester resins; crosslinked polyurethanes; polyisocyanurates; crosslinked elastomers, including but not limited to, polyisoprene, polybutadiene, styrene-butadiene, styrene-isoprene, ethylene-propylene-diene monomer polymer; and blends thereof.

In some embodiments, suitable polymers for one or more solid carbon-based feedstocks include, for example, one or more polyesters, one or more polyolefins (PO), and/or polyvinyl chloride (PVC). Representative examples of suitable polymers for one or more solid carbon-based feedstocks include one or more of elected from the group consisting of a polyethylene (PE), a polypropylene (PP), a polyethylene terephthalate (PET), a polyvinyl chloride (PVC), a polystyrene (PS), an aromatic polymer such as polysulfone, polycarbonate (PC), polyphenylene sulfide (PPS), polyimides polysulfone (PSU) and mixtures thereof.

Suitable biomass for the one or more feedstocks comprising a solid carbon-based material includes, for example, plant and plant-derived material, vegetation, agricultural waste, forestry waste, wood waste, paper waste, animal-derived waste, poultry-derived waste, municipal solid waste, cellulose, carbohydrates or derivates thereof, charcoal, and the like, and combinations/mixtures thereof.

Representative examples of biomass that can additionally or alternately be present as solid carbon-based feedstock components can include, but are not limited to, timber harvesting residues, softwood chips, hardwood chips, tree branches, tree stumps, leaves, bark, sawdust, off-spec paper pulp, corn, corn cob, corn stover, wheat straw, rice straw, sugarcane bagasse, switchgrass, miscanthus, animal manure, municipal garbage, municipal sewage, commercial waste, grape pumice, almond shells, pecan shells, coconut shells, coffee grounds, grass pellets, hay pellets, wood pellets, cardboard, paper, plastic, cloth, and the like, and combinations/mixtures thereof.

The waste plastic may originate from one or more of several sources. In an illustrative embodiment, as may be combined with one or more of the preceding paragraphs, the waste plastic may originate from, for example, plastic bottles, diapers, eyeglass frames, films, packaging materials, carpet (residential, commercial, and/or automotive), textiles (clothing and other fabrics) and combinations thereof. This list is merely illustrative, and any source of waste plastic is contemplated herein.

In an illustrative embodiment, as may be combined with one or more of the preceding paragraphs, a waste plastic includes, for example, a low melting point polyethylene (LMPPE). In an illustrative embodiment, a low melting point polyethylene has a melting point of less than about 100° C. In an illustrative embodiment, a low melting point polyethylene has a melting point of from about 35° C. to about 100° C. In an illustrative embodiment, a low melting point polyethylene has a melting point of from about 40° C. to about 80° C. In an illustrative embodiment, a low melting point polyethylene has a melting point of from about 45° C. to about 60° C. In an illustrative embodiment, a low melting point polyethylene has a melting point of from about 60° C. to about 70° C. The melting point of the low melting point polyethylene can be determined by differential scanning calorimetry (DSC).

In an illustrative embodiment, as may be combined with one or more of the preceding paragraphs, a waste plastic includes, for example, high-density polyethylene (HDPE), low-density polyethylene (LDPE), high molecular weight polyethylene (HMWPE), low molecular weight polyethylene (LMWPE), polypropylene (PP), polystyrene (PS) and mixed plastics, e.g., a mixture of polyethylene (PE), polypropylene (PP), and polystyrene (PS) or a mixture of LDPE, HDPE and PP.

In an illustrative embodiment, a high-density polyethylene has a number average molecular weight of about 100,000 to about 250,000 Daltons. In an illustrative embodiment, an ultra-high molecular weight polyethylene can have a number average molecular weight of at least about 500,000 Daltons. In an illustrative embodiment, a high molecular weight polyethylene can have a number average molecular weight of from about 50,000 to about 400,000 Daltons. In an illustrative embodiment, a low molecular weight polyethylene can have a number average molecular weight of from about 5,000 to about 50,000 Daltons. In an illustrative embodiment, a high molecular weight polypropylene can have a number average molecular weight of from about 100,000 to about 700,000 Daltons. In an illustrative embodiment, a high molecular weight polypropylene can have a weight average molecular weight of from about 220,000 to about 700,000 Daltons. In an illustrative embodiment, a low molecular weight polypropylene can have a number average molecular weight of from about 10,000 to about 100,000 Daltons.

In an illustrative embodiment, as may be combined with one or more of the preceding paragraphs, a waste plastic can comprise at least about 50, or at least about 55, or at least about 60, or at least about 65, or at least about 70, or at least about 75, or at least about 80, or at least about 85, or at least about 95, or at least about 99 weight percent of, for example, polyolefins such as high-density polyethylene (HDPE), low-density polyethylene (LDPE), ultra-high molecular weight polyethylene, and polypropylene (PP), polyvinyl chloride (PVC), polyvinylidene chloride (PVDC), polyesters such as polyethylene terephthalate (PET), copolyesters and terephthalate copolyesters (e.g., containing residues of TMCD, CHDM, propylene glycol, or NPG monomers), polyamides, poly(methyl methacrylate), polytetrafluoroethylene, acrylonitrile-butadiene-styrene (ABS), polyurethanes, cellulose and derivatives thereof (e.g., cellulose diacetate, cellulose triacetate, or regenerated cellulose), epoxy, phenolic resins, polyacetal, polycarbonates, polyphenylene-based alloys, polystyrene, styrenic compounds, vinyl based compounds, styrene acrylonitrile, polyvinyl acetals (e.g., PVB), urea based polymers, melamine containing polymers, thermosetting, thermoplastic elastomers other than tires, and/or elastomeric polymers and the like and combinations thereof.

Examples of polyesters may include, but are not limited to, those having repeating aromatic or cyclic units such as those containing a repeating terephthalate, isophthalate, or naphthalate units such as polyethylene terephthalate (PET), modified PET, or those containing repeating furanate repeating units. As used herein, "PET" or "polyethylene terephthalate" refers to a homopolymer of polyethylene terephthalate, or to a polyethylene terephthalate modified with one or more acid and/or glycol modifiers and/or containing residues or moieties of other than ethylene glycol and terephthalic acid, such as isophthalic acid, 1,4-cyclohexanedicarboxylic acid, diethylene glycol, 2,2,4,4-tetramethyl-1,3-cyclobutanediol (TMCD), cyclohexanedimethanol (CHDM), propylene glycol, isosorbide, 1,4-butanediol, 1,3-propane diol, and/or neopentyl glycol (NPG).

Also included within the definition of the terms "PET" and "polyethylene terephthalate" are polyesters having repeating terephthalate units (whether or not they contain repeating ethylene glycol-based units) and one or more residues or moieties of a glycol including, for example, TMCD, CHDM, propylene glycol, or NPG, isosorbide, 1,4-butanediol, 1,3-propane diol, and/or diethylene glycol, or combinations thereof. Examples of polymers with repeat terephthalate units can include, but are not limited to, polypropylene terephthalate, polybutylene terephthalate, and copolyesters thereof. Examples of aliphatic polyesters can include, but are not limited to, polylactic acid (PLA), polyglycolic acid, polycaprolactones, and polyethylene adipates. The polymer may comprise mixed aliphatic-aromatic copolyesters including, for example, mixed terephthalates/adipates.

In an illustrative embodiment, as may be combined with one or more of the preceding paragraphs, the waste plastic may comprise terephthalate repeating units in an amount of at least about 1, at least about 5, at least about 10, at least about 15, at least about 20, at least about 25, at least about 30, at least about 35, at least about 40, or at least about 45 and/or not more than about 75, not more than about 70, not more than about 60, or not more than about 65 weight percent, based on the total weight of the plastic in the waste plastic stream, or it may include terephthalate repeat units in an amount in the range of from about 1 weight percent to about 75 weight percent, about 5 weight percent to about 70 weight percent, or about 25 weight percent to about 75 weight percent, based on the total weight of the stream.

Examples of polyolefins may include, but are not limited to, high-density polyethylene (HDPE), low-density polyethylene (LDPE), high molecular weight polyethylene (HMWPE), low molecular weight polyethylene (LMWPE), polypropylene (PP), atactic polypropylene, isotactic polypropylene, syndiotactic polypropylene, crosslinked polyethylene, amorphous polyolefins, and the copolymers of any one of the aforementioned polyolefins. In an illustrative embodiment, as may be combined with one or more of the preceding paragraphs, the waste plastic may include polymers including linear low-density polyethylene (LLDPE), polymethylpentene, polybutene-1, and copolymers thereof. In an embodiment, the waste plastic may comprise flashspun high-density polyethylene.

In an illustrative embodiment, as may be combined with one or more of the preceding paragraphs, a waste plastic can include, for example, thermosetting, thermoplastic, and/or elastomeric plastics. For example, the number average molecular weight of the thermosetting, thermoplastic, and/or elastomeric plastics can be at least about 300, or at least about 500, or at least about 1000, or at least about 5,000, or at least about 10,000, or at least about 20,000, or at least about 30,000, or at least about 50,000 or at least about 70,000 or at least about 90,000 or at least about 100,000, or at least about 130,000 and up to about 300,000, or up to about 200,000, or up to about 150,000, or up to about 100,000, or up to about 90,000, or up to about 70,000, or up to about 50,000, or up to about 30,000, or up to about 20,000, or up to about 10,000, or up to about 5,000, or up to about 1,000 Daltons.

Examples of cellulose materials include, but are not limited to, cellulose acetate, cellulose diacetate, cellulose triacetate, cellulose acetate propionate, cellulose acetate butyrate, as well as regenerated cellulose such as viscose. Additionally, the cellulose materials can include cellulose derivatives having an acyl degree of substitution of less than about 3, not more than about 2.9, not more than about 2.8, not more than about 2.7, or not more than about 2.6 and/or at least about 1.7, at least about 1.8, or at least about 1.9.

In an illustrative embodiment, as may be combined with one or more of the preceding paragraphs, a waste plastic may include a mixed plastic waste ("MPW") containing any combination of the foregoing waste plastics.

In an illustrative embodiment, as may be combined with one or more of the preceding paragraphs, a waste plastic can be any organic synthetic polymer that is solid at 25° C. at 1 atm. For example, in an illustrative embodiment, the organic synthetic polymers that are solid at 25° C. and 1 atmosphere of pressure may have a number average molecular weight (Mn) of at least about 300, or at least about 500, or at least about 1000, or at least about 5,000, or at least about 10,000, or at least about 20,000, or at least about 30,000, or at least about 50,000 or at least about 70,000 or at least about 90,000 or at least about 100,000 or at least about 130,000, or at least about 150,000 Daltons. The weight average molecular weight (Mw) of the polymers can be at least about 300, or at least about 500, or at least about 1000, or at least about 5,000, or at least about 10,000, or at least about 20,000, or at least about 30,000 or at least about 50,000, or at least about 70,000, or at least about 90,000, or at least about 100,000, or at least about 130,000, or at least about 150,000, or at least about 300,000 or at least about 400,000 Daltons. In an embodiment or in combination with any embodiment mentioned herein, the polymers have an average molecular weight, Mw, in the range of about 5,000 to about 150,000 Daltons. In an embodiment or in combination with any embodiment mentioned herein, the polymers have an average molecular weight, Mw, in the range of greater than about 150,000 to about 400,000 Daltons.

In an illustrative embodiment, as may be combined with one or more of the preceding paragraphs, a waste plastic can include at least about 50, or at least about 55, or at least about 60, or at least about 65, or at least about 70, or at least about 75, or at least about 80, or at least about 85, or at least about 95, or at least about 99 weight percent of recycled textiles and/or recycled carpet, such as synthetic fibers, rovings, yarns, nonwoven webs, cloth, fabrics and products made from or containing any of the aforementioned plastics. The textiles can include woven, knitted, knotted, stitched, tufted, felted, embroidered, laced, crocheted, braided, or nonwoven webs and materials. The textiles can include fabrics, fibers separated from a textile or other product containing fibers, scrap or off spec fibers or yarns or fabrics, or any other source of loose fibers and yarns. Furthermore, the textiles may also include staple fibers, continuous fibers, threads, tow bands, twisted and/or spun yarns, grey fabrics made from yarns, finished fabrics produced by wet processing gray fabrics, garments made from the finished fabrics, or any other fabrics. Textiles include apparels, interior furnishings, and industrial types of textiles. Textiles also include post-industrial textiles or post-consumer textiles or both.

Examples of textiles in the apparel category (things humans wear or made for the body) include, but are not limited to, sports coats, suits, trousers and casual or work pants, shirts, socks, sportswear, dresses, intimate apparel, outerwear such as rain jackets, cold temperature jackets and coats, sweaters, protective clothing, uniforms, and accessories such as scarves, hats, and gloves. Examples of textiles in the interior furnishing category include furniture upholstery and slipcovers, carpets and rugs, curtains, bedding such as sheets, pillow covers, duvets, comforters, mattress covers; linens, tablecloths, towels, washcloths, and blankets. Examples of industrial textiles include transportation (auto, airplanes, trains, buses) seats, floor mats, trunk liners, and headliners; outdoor furniture and cushions, tents, backpacks, luggage, ropes, conveyor belts, calendar roll felts, polishing cloths, rags, soil erosion fabrics and geotextiles, agricultural mats and screens, personal protective equipment, bullet proof vests, medical bandages, sutures, tapes, and the like.

The nonwoven webs that are classified as textiles do not include the category of wet laid nonwoven webs and articles made therefrom. While a variety of articles having the same function can be made from a dry or wet laid process, the article made from the dry laid nonwoven web is classified as a textile. Examples of suitable articles that may be formed from dry laid nonwoven webs as described herein can include those for personal, consumer, industrial, food service, medical, and other types of end uses. Specific examples can include, but are not limited to, baby wipes, flushable wipes, disposable diapers, training pants, feminine hygiene products such as sanitary napkins and tampons, adult incontinence pads, underwear, or briefs, and pet training pads. Other examples include a variety of different dry or wet wipes, including those for consumer (such as personal care or household) and industrial (such as food service, health care, or specialty) use.

Nonwoven webs can also be used as padding for pillows, mattresses, and upholstery, batting for quilts and comforters. In the medical and industrial fields, nonwoven webs of the present invention may be used for medical and industrial face masks, protective clothing, caps, and shoe covers, disposable sheets, surgical gowns, drapes, bandages, and medical dressings. Additionally, nonwoven webs as described herein may be used for environmental fabrics such as geotextiles and tarps, oil and chemical absorbent pads, as well as building materials such as acoustic or thermal insulation, tents, lumber and soil covers and sheeting. Nonwoven webs may also be used for other consumer end use applications, such as for, carpet backing, packaging for consumer, industrial, and agricultural goods, thermal or acoustic insulation, and in various types of apparel. The dry laid nonwoven webs as described herein may also be used for a variety of filtration applications, including transportation (e.g., automotive or aeronautical), commercial, residential, industrial, or other specialty applications. Examples can include filter elements for consumer or industrial air or liquid filters (e.g., gasoline, oil, water), including nanofiber webs used for microfiltration, as well as end uses like tea bags, coffee filters, and dryer sheets. Further, nonwoven webs as described herein may be used to form a variety of components for use in automobiles, including, but not limited to, brake pads, trunk liners, carpet tufting, and under padding.

The textiles can include a single type or multiple types of natural fibers and/or a single type or multiple types of synthetic fibers. Examples of textile fiber combinations include all natural, all synthetic, two or more types of natural fibers, two or more types of synthetic fibers, one type of natural fiber and one type of synthetic fiber, one type of natural fibers and two or more types of synthetic fibers, two or more types of natural fibers and one type of synthetic fibers, and two or more types of natural fibers and two or more types of synthetic fibers.

Natural fibers include those that are plant derived or animal derived. Natural fibers can be cellulosics, hemicellulosics, and lignins. Examples of plant derived natural fibers include hardwood pulp, softwood pulp, and wood flour; and other plant fibers including those in wheat straw, rice straw, abaca, coir, cotton, flax, hemp, jute, bagasse, kapok, papyrus, ramie, rattan, vine, kenaf, abaca, henequen, sisal, soy, cereal straw, bamboo, reeds, esparto grass, bagasse, Sabai grass, milkweed floss fibers, pineapple leaf fibers, switch grass, lignin-containing plants, and the like. Examples of animal derived fibers include wool, silk, mohair, cashmere, goat hair, horsehair, avian fibers, camel hair, angora wool, and alpaca wool.

Synthetic fibers are those fibers that are, at least in part, synthesized or derivatized through chemical reactions, or regenerated, and include, but are not limited to, rayon, viscose, mercerized fibers or other types of regenerated cellulose (conversion of natural cellulose to a soluble cellulosic derivative and subsequent regeneration) such as lyocell (also known as TENCEL™), Cupro, Modal, acetates such as polyvinyl acetate, polyamides including nylon, polyesters such as PET, olefinic polymers such as polypropylene and polyethylene, polycarbonates, poly sulfates, polysulfones, polyethers such as polyether-urea known as Spandex or elastane, polyacrylates, acrylonitrile copolymers, polyvinyl chloride (PVC), polylactic acid, polyglycolic acid, sulfopolyester fibers, and combinations thereof.

The textiles can be in any of the forms mentioned above, such as size reduction via chopping, shredding, harrowing, confrication, pulverizing, or cutting a feedstock of textiles to make size reduced textiles. The textiles can also be densified. Examples of processes that densify include those that agglomerate the textiles through heat generated by frictional forces or particles made by extrusion or other external heat applied to the textile to soften or melt a portion or all of the textile.

The waste plastic can be obtained from a plastic source including, by way of example, a hopper, storage bin, railcar, over-the-road trailer, or any other device that may hold or store waste plastics. In an embodiment, the plastic source can include a municipal reclaimer facility, an industrial facility, a recycling facility, a commercial facility, a manufacturing facility, or combinations thereof.

In an illustrative embodiment, as may be combined with one or more of the preceding paragraphs, the one or more feedstocks comprising a solid carbon-based material can be washed to remove any metal contaminants either before entering storage unit 102 or after exiting storage unit 102. Representative examples of metal contaminants include sodium, calcium, magnesium, aluminum, and non-metal contaminants coming from other waste sources. Non-metal contaminants include contaminants coming from the Periodic Table Group 14, such as silica, contaminants from Group 15, such as phosphorus and nitrogen compounds, contaminants from Group 16, such as sulfur compounds, and halide contaminants from Group 17, such as fluoride, chloride, and iodide. The residual metals, non-metal contaminants, and halides may be removed to less than about 50 parts per million (ppm), or less than about 30 ppm or less than about 5 ppm if required by equipment design and metallurgy.

Turning back to FIGS. 1A and 1B, system 100 further includes a transfer device 106 for receiving the one or more feedstocks comprising a solid carbon-based material via line 104. In some embodiments, transfer device 106 can be a bucket elevator, a solid conveyer, or a pneumatic transportation system for sending the one or more feedstocks comprising a solid carbon-based material such as in a solid form to a coke drum 110 via line 108. In some embodiments, transfer device 106 can be any suitable pump for increasing the pressure of the one or more feedstocks comprising a solid carbon-based material such as in a slurry form for sending the one or more feedstocks comprising a solid carbon-based material to coke drum 110 via line 108. For example, transfer device 106 may be a centrifugal pump, a rotary pump including an impeller, or alternatively may be any other suitable fluid pump. In some embodiments, transfer device 106 is a large recirculation pump.

System 100 further includes a valve 109 for allowing the one or more feedstocks comprising a solid carbon-based material to enter coke drum 110 via line 108.

System 100 further includes coke drum 110 for receiving a purge stream via line 105 using a valve 107 and the one or more feedstocks comprising a solid carbon-based material via line 108 using valve 109. In some embodiments, purge stream can include, for example, steam, light hydrocarbon gases, hydrogen, nitrogen and carbon dioxide. Coke drum 110 can be any conventional coke drum design used in refinery processing units. Coke drum 110 further includes a heating element 112 for heating the one or more solid carbon-based feedstocks in coke drum 110. In some embodiments, heating element 112 is external to coke drum 110. In some embodiments, heating element 112 is internal to coke drum 110. Although heating element 112 is shown as a single heating element, this is merely illustrative and any number of external and/or internal heating elements are contemplated for use in system 100.

Heating element 112 is a dedicated heating element to heat the one or more feedstocks comprising a solid carbon-based material in coke drum 110. Heating element 112 can be any conventional heating unit known in the art. In some embodiments, heating element 112 can provide heat to coke drum 110 using, for example, electric heating, microwave heating, ultrasonic heating, induction heating, direct electric energy or sources or electromagnetic sources. In some embodiments, heating element 112 can be a super gas or vapor heater such as a steam heater, and may include a heating element, such as a resistive or inductive heating element. In some embodiment, heating element 112 can be an air heater, which may include a resistive or inductive heating element configured to heat air, carbon dioxide or inert gas.

In some embodiments, heating element 112 includes electromagnetic radiation. In an embodiment, electromagnetic radiation comprises UV light, near ultraviolet light, near infrared light, infrared light, visible light, laser, electron beam, or combinations thereof.

In some embodiments, heating element 112 includes a furnace heater. For example, a furnace heater can heat the one or more feedstocks comprising a solid carbon-based material in coke drum 110 using an exhaust heated by a burner that combusts a portion of, for example, a fuel gas stream such as natural gas or gasoline.

In non-limiting illustrative embodiments, the one or more feedstocks comprising a solid carbon-based material enter coke drum 110 in which coke drum 110 is in an unheated state, i.e., coke drum 110 is at room temperature, via line 108 and heating element 112 heats the one or more feedstocks comprising a solid carbon-based material to a first temperature sufficient to convert the heated one or more feedstocks comprising a solid carbon-based material to one of a semi-solid state or melted state.

Figure 2:
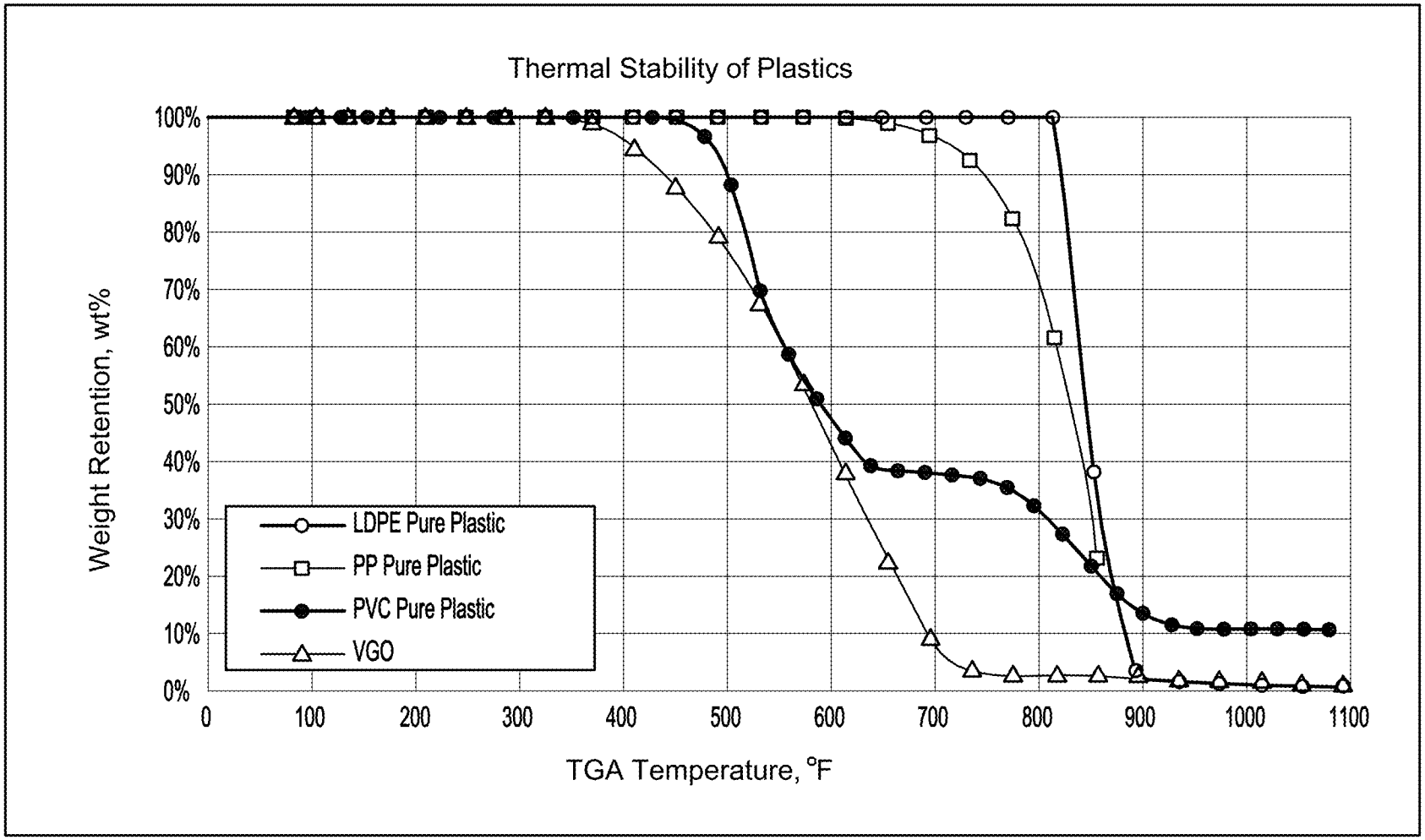
FIG. 2 illustrates a comparison chart showing the differences in thermal stability between polyethylene, polypropylene, and polyvinyl chloride.

In some embodiments, heating element 112 can heat the one or more feedstocks comprising a solid carbon-based material to a temperature ranging from about 160° C. to about 320° C. For example, depending on the particular feedstock comprising a solid carbon-based material such as a plastic feed source and the process configuration, the first temperature for heating coke drum 110 can be a narrower range such as from about 160° C. to about 260° C. (about 320° F. to about 500° F.) or about 260° C. to about 320° C. (about 500° F. to about 608° F.). As one skilled in the art will appreciate, at a temperature of about 160° C., all polyethylene and polypropylene plastics can be dissolved while the decomposition of polyvinyl chloride is minimized. Upon further continued heating up to about 320° C., polyvinyl chloride will decompose gradually and produce a substantial amount of HCl and some organic chlorides. Thus, by employing a dedicated, gradual heating herein, rapid decomposition of polyvinyl chloride and other plastics in an uncontrolled reaction is minimized. Polyethylene is stable up to about 427° C. (800° F.) and polypropylene is stable up to about 371° C. (700° F.), at which temperatures they begin to decompose. Thus, by limiting the upper limit of the first temperature to about 320° C. (608° F.), most of the plastics are in a melted form but intact and stable, while polyvinyl chloride is selectively decomposed (see, e.g., FIG. 2). Accordingly, the heated feedstock comprising a solid carbon-based material can now be safely mixed with a petroleum residue feedstock to proceed to the coking process without jeopardizing coke drum 110.

As one skilled in the art will readily appreciate, when the one or more feedstocks comprising a solid carbon-based material is a single feedstock, the melting point is of that particular feedstock. In the case where the one or more feedstocks comprising a solid carbon-based material are more than one feedstock, then the melting point of the one or more feedstocks comprising a solid carbon-based material will be the melting point of the feedstock comprising a solid carbon-based material with the highest melting point. Thus, the melting points of all the feedstocks comprising a solid carbon-based material must be exceeded.

Although it is shown that the one or more feedstocks comprising a solid carbon-based material enter coke drum 110 via line 108, it is contemplated that the one or more feedstocks comprising a solid carbon-based material can enter coke drum 110 at more than one inlet and at any position of coke drum 110. For example, the one or more feedstocks comprising a solid carbon-based material can enter coke drum 110 at one or more of a bottom inlet, a middle inlet and a top inlet of coke drum 110.

In some embodiments, following heating the one or more feedstocks comprising a solid carbon-based material to a temperature sufficient to convert the heated one or more feedstocks comprising a solid carbon-based material to one of a semi-solid state or melted state, coke drum 110 further receives a heated petroleum residue-containing feedstock via a line 136-1. As will be discussed below, the petroleum residue-containing feedstock can include a petroleum residue stream, as well as a heavy bottoms from a fractionator 116. In some embodiments, a petroleum residue stream can include, for example, a heavy bottoms from processing of crude oil in a crude unit, a heavy cycle oil of a fluid catalytic cracking unit, tar, etc. In some embodiments, a petroleum residue stream can include, for example, residue from an atmospheric distillation column, residue from a vacuum distillation column, residue from a visbreaker, fuel oil, pitch from solvent deasphalting, or any combination of these. As used herein, the term "heavy" means having a higher boiling point and the term "light" means having a lower boiling point.

When entering coke drum 110, the heated petroleum residue-containing feedstock will be a temperature ranging from about 450° C. to about 650° C. Thus, this temperature may be sufficient such that the heated one or more feedstocks comprising a solid carbon-based material in one of a semi-solid state or a melted state and the heated petroleum residue-containing feedstock can undergo one or more reactions such as, for example, pyrolysis, thermal cracking, decomposition, and annealing to convert the heated one or more feedstocks comprising a solid carbon-based material in one of a semi-solid or melted state to a product stream comprising a gas phase comprising hydrocarbons and hydrogen, and coke. If necessary, heating element 112 can be used to further add additional heat to coke drum 110 to assist in the one or more reactions.

In some embodiments, the one or more feedstocks comprising a solid carbon-based material first enter coke drum 110 until a sufficient amount is present in coke drum 110. In non-limiting illustrative embodiments, a sufficient amount includes, for example, the one or more feedstocks comprising a solid carbon-based material filling from about 10% to about 50%, or from 10% to about 30% of coke drum 110. Once a sufficient amount of the one or more feedstocks comprising a solid carbon-based material is reached in coke drum 110, the one or more feedstocks comprising a solid carbon-based material are then heated by heating element 112 until the heated one or more feedstocks comprising a solid carbon-based material are in one of a semi-solid state or melted state. Next, the heated petroleum residue-containing feedstock enters coke drum 110 to assist in converting the one or more feedstocks comprising a solid carbon-based material to a product stream comprising a gas phase comprising hydrocarbons and hydrogen and coke.

In some embodiments, if any oxygen is present in coke drum 110 prior to heating coke drum 110, a typical air freeing operation can be performed including the use of steam or an inert gas such as nitrogen or carbon dioxide.

In a non-limiting illustrative embodiment, the heated one or more feedstocks comprising a solid carbon-based material in one of a semi-solid state or a melted state and the heated petroleum residue-containing feedstock are pyrolyzed in coke drum 110. The pyrolysis reaction involves chemical and thermal decomposition of the heated one or more feedstocks comprising a solid carbon-based material in one of a semi-solid state or a melted state and the heated petroleum residue-containing feedstock. Although pyrolysis processes may be generally characterized by a reaction environment that is substantially free of oxygen, pyrolysis processes may be further defined, for example, by the pyrolysis reaction temperature within the reactor, the residence time in the pyrolysis reactor, the pressure within the pyrolysis reactor, and the presence or absence of pyrolysis catalysts.

In some embodiments, the pyrolysis reaction can involve heating and converting the heated one or more feedstocks comprising a solid carbon-based material in one of a semi-solid state or a melted state and the heated petroleum residue-containing feedstock under an anaerobic atmosphere. An anaerobic atmosphere may be a non-oxidizing atmosphere without oxygen in or is substantially free of oxygen or in an atmosphere that contains less oxygen relative to ambient air. For example, the atmosphere within coke drum 110 may include not more than 5 wt. %, not more than 4 wt. %, not more than 3 wt. %, not more than 2 wt. %, not more than 1 wt. %, or not more than 0.5 wt. % of oxygen.

In some embodiments, additives such as, for example, silicon, iron and molybdenum can be added via line 108 in order to affect the morphology of the coke formed.

The temperature in coke drum 110 to pyrolyze the heated one or more feedstocks comprising a solid carbon-based material in one of a semi-solid state or a melted state and the heated petroleum residue-containing feedstock can be adjusted to facilitate the production of certain end products. In some embodiments, a suitable temperature includes, for example, at least about 325° C., or at least about 350° C., or at least about 375° C., or at least about 400° C. In some embodiments, a suitable temperature includes, for example, a temperature of not more than about 800° C., or not more than about 700° C., or not more than about 650° C., or not more than about 600° C., or not more than about 550° C., or not more than about 525° C., or not more than about 500° C. In some embodiments, a suitable temperature includes, for example, a temperature of from about 325° C. to about 800° C., or about 350° C. to about 600° C., or about 375° C. to about 500° C., or about 400° C. to about 500° C.

In some embodiments, the reaction conditions can include, for example, a suitable residence time of the heated one or more feedstocks comprising a solid carbon-based material in one of a semi-solid state or a melted state and the heated petroleum residue-containing feedstock within coke drum 110 can be at least about 10 hours, or from about 10 hours to about 48 hours, or from about 12 hours to about 24 hours. In some embodiments, the reaction conditions can include, for example, maintaining the coke drum 110 at a pressure of at least about 1 atmosphere, or from about 1 atmosphere to about 10 atmospheres. In some embodiments, coke drum 110 can be maintained at a pressure of less than about 1 atmosphere or under vacuum. Any combination of the foregoing ranges with the residence time and the pressure are contemplated including combinations of the residence time with the pressure.

In some embodiments, the pyrolysis reaction in coke drum 110 can be a thermal pyrolysis, which is carried out in the absence of a catalyst, or a catalytic pyrolysis, which is carried out in the presence of a catalyst. When a catalyst is used, the catalyst can be homogenous or heterogeneous and may include, for example, certain types of zeolites and other mesostructured catalysts.

In some embodiments, the pyrolysis reaction results in a product stream comprising a gas phase comprising hydrocarbons and hydrogen, and coke. In some embodiments, the product stream exits coke drum 110 via line 114 and is sent to fractionator 116 as discussed below, and coke remains in coke drum 110 (see FIG. 1A). In some embodiments, the product stream exits coke drum 110 via line 114 and is combined with a product stream via line 122 from a coke drum 118 as discussed below and sent to fractionator 116 (see FIG. 1A). In some embodiments, the product stream exits coke drum 110 via line 114 using valve 115 and is sent to fractionator 116 as discussed below, and coke remains in coke drum 110 (see FIG. 1B) for further processing. In some embodiments, the product stream exits coke drum 110 via line 114 using valve 115 and is combined with another product stream via line 122 using valve 123 from coke drum 118 as discussed below and sent to fractionator 116 (see FIG. 1B).

In a non-limiting illustrative embodiment, thermal cracking of the heated one or more feedstocks comprising a solid carbon-based material in one of a semi-solid state or a melted state and the heated petroleum residue-containing feedstock is carried out in coke drum 110. In some embodiments, the thermal cracking operation is carried out in the presence of steam under an anaerobic atmosphere as discussed above. In some embodiments, the thermal cracking operation in coke drum 110 can be carried out in the absence of a catalyst.

Suitable thermal cracking conditions include, for example, a reaction temperature of about 450° C. to about 600° C., or about 500° C. to about 550° C., a suitable residence time of the solid carbon-based feedstock within coke drum 110 can be at least about 10 hours, or from about 12 hours to about 48 hours, and a pressure ranging from about 1 atm to about 10 atm, or from about 1 atm to about 5 atm, or from about 5 atm to about 10 atm.

In some embodiments, the thermal cracking operation results in a product stream comprising a gas phase comprising hydrocarbons and hydrogen, and coke.

In some embodiments, the product stream exits coke drum 110 via line 114 and is sent to fractionator 116 as discussed below, and coke remains in coke drum 110 (see FIG. 1A). In some embodiments, the product stream exits coke drum 110 via line 114 and is combined with a product stream via line 122 from coke drum 118 as discussed below and sent to fractionator 116 (see FIG. 1A). In some embodiments, the product stream exits coke drum 110 via line 114 using valve 115 and is sent to fractionator 116 as discussed below, and coke remains in coke drum 110 (see FIG. 1B). In some embodiments, the product stream exits coke drum 110 via line 114 using valve 115 and is combined with a product stream via line 122 using valve 123 from coke drum 118 as discussed below and sent to fractionator 116 (see FIG. 1B).

In some embodiments, when the reaction of the heated one or more feedstocks comprising a solid carbon-based material in one of a semi-solid state or a melted state and the heated petroleum residue-containing feedstock in coke drum 110 is complete based on, for example, time of reaction, a complete reaction or that coke drum 110 is substantially full or completely full of coke, the reaction and coking cycle ends and the one or more feedstocks comprising a solid carbon-based material is transferred from coke drum 110 to another parallel coke drum, e.g., coke drum 118, to initiate another reaction and coking cycle of the one or more feedstocks comprising a solid carbon-based material and the heated petroleum residue-containing feedstock, while a coke removal process is initiated in coke drum 110. The term "substantially full" shall be understood to mean the at coke drum 110 contains greater than 70% of coke, or greater than 90% of coke.

In some embodiments, when the reaction and coking cycle in coke drum 110 is complete, the coke removal process begins in coke drum 110 and the one or more feedstocks comprising a solid carbon-based material and the heated petroleum residue-containing feedstock is then sent to coke drum 118 for processing as discussed below. The coke removal process includes, for example, steaming, water cooling, coke cutting, and gas heating and draining. The wash liquid and vapor from the coke drum is discharged mostly into a blow down section. In some embodiments, the wash liquid and vapor can be indirectly sent to fractionator 116. The coke is removed from the bottom of coke drum 110 for further processing (not shown).

System 100 further includes fractionator 116. In some embodiments, fractionator 116 may include one or more distillation columns. For example, the product stream comprising a gas phase comprising hydrocarbons and hydrogen obtained in coke drum 110 and optionally the product stream obtained in a coke drum 118, as discussed below, may be separated into one or more hydrocarbon fractions. The hydrocarbons present in the product stream can be in various forms. For example, in some embodiments, the product stream may include dry gases (e.g., one of more of hydrogen, methane, and ethane), liquefied petroleum gases (e.g., one or more of propane and butane), light olefins (e.g., one or more of ethylene, propylene, and butylene-based olefins), gasoline (e.g., a boiling range of $C_5$ to about 221° C.), a light gas oil (e.g., a boiling range of about 221° C.+ to about 343° C.) and heavy bottoms such as a heavy gas oil (e.g., a boiling range of about 343° C.+ to final boiling temperature).

In some embodiments, the product stream obtained in coke drum 110 and coke drum 118 may include one or more of dry gases (e.g., one of more of hydrogen, methane, and ethane), liquefied petroleum gases (e.g., one or more of propane and butane), light olefins (e.g., one or more of ethylene, propylene, and butylene-based olefins), gasoline (e.g., a boiling range of $C_5$ to about 221° C.), kerosene (JET, 150° C. to ~300° C.), diesel (200° C. to 350° C.) and heavy bottoms such as a heavy coker gas oil and a heavy heavy coker gas oil. For example, the processed one or more feedstocks comprising a solid carbon-based material can have a variety of cracked hydrocarbon products that may be separated into two or more constituent streams by conventional means. In non-limiting illustrative embodiments, constituent streams may include one or more of a fuel gas stream, an ethylene stream, a propylene stream, a butylene stream, a naphtha stream, an olefin stream, liquefied petroleum gas (LPG), a gasoline stream, a kerosene stream, a diesel stream, a light coker gas oil (LCGO), a heavy bottoms including one or more of a heavy coker gas oil (HCGO) stream and a heavy-heavy coker gas oil (HHCGO) stream, and other hydrocarbon streams.

In some embodiments, the product stream may comprise from about 10 wt. % to about 30 wt. % (e.g., from about 10 wt. % to about 25 wt. %) of gasoline boiling range hydrocarbons, as determined by ASTM D2887. In some aspects, gasoline boiling range hydrocarbons may comprise at least about 25 wt. % (e.g., at least about 30 wt. %, or about 40 wt. % to about 50 wt. %) of $C_5$ to $C_{10}$ hydrocarbons such as $C_6$ to $C_8$ aromatics including 20 to 50 mole percent unsaturated olefinic and aromatic compounds. The obtained gasoline fraction may be useful as high-quality gasoline fuel and/or naphtha fuel, or as a blending component for these fuels or may require further refinement or treatment.

In some embodiments, the product stream may comprise at least about 25 wt. % (e.g., about 25 wt. % to about 40 wt. %, or about 30 wt. % to about 40 wt. %) $C_3$ to $C_5$ olefins, as determined by ASTM D2887. In some embodiments, $C_3$ to $C_5$ product olefins can be directed to a petrochemical unit or to an alkylation unit to produce a bio-based high-octane gasoline by the reaction of an isoparaffin (e.g., isobutane) with one or more of the olefins (e.g., propylene and butylene).

Hydrocarbon fractions may undergo further processing before commercial use. In some aspects, a constituent stream may be further processed. In an illustrative embodiment, an olefinic constituent stream may be sent to an alkylation unit for further processing. For example, a $C_3$ olefin/paraffin mix stream of propane and propylene mix can be sent to and separated by a propane/propylene splitter (PP splitter) to produce pure streams of propane and propylene. In some embodiments, the propylene can be fed to a propylene polymerization unit to produce polypropylene.

In some embodiments, the pure propane may be fed to a propane dehydrogenation unit to make additional propylene, and then ultimately polypropylene in the propylene polymerization unit.

In addition, olefins from the constituent streams may be further separated and recovered for use in plastics and petrochemicals.

In some embodiments, $C_4$ and other hydrocarbon product streams, such as a heavy fraction, can be sent to appropriate refinery units for upgrading into clean gasoline, diesel, or jet fuel. The gasoline from the coke drum may be passed directly to a gasoline pool or further upgraded before being sent to a gasoline pool.

Hydrocarbon fuel products may be sold or further processed. Examples of further processing include blending, hydroprocessing, desulfurization, separation, or alkylating at least a portion of the hydrocarbon fuel product. Hydrocarbon fuel products may be used as a blend stock and combined with one or more petroleum fuel products and/or renewable fuels. Petroleum-based streams include gasoline, diesel, aviation fuel, or other hydrocarbon streams obtained by refining of petroleum. Examples of renewable fuels include ethanol, propanol, and butanol.

Returning back to FIGS. 1A and 1B, as mentioned above, one of the separated constituent streams in fractionator 116 is a heavy bottoms stream including, for example, a heavy coker gas oil (HCGO) stream and/or a heavy heavy coker gas oil (HHCGO) stream. In some embodiments, the heavy bottoms stream such as the HCGO stream or HHCGO stream is combined with a petroleum residue stream as discussed above. In some embodiments, the petroleum residue stream enters fractionator 116 via a line 124 and exits fractionator 116 via a line 125 with one of the heavy bottoms streams such as the HCGO stream or HHCGO stream and sent to a pump 126 as a petroleum residue-containing feedstock. Pump 126 can be any suitable pump as discussed above for transfer device 106 for increasing the pressure of the petroleum residue-containing feedstock for sending a first pressurized petroleum residue-containing feedstock to a heating unit 134 via line 128.

The first pressurized petroleum residue-containing feedstock can be combined with an optional supplemental petroleum residue stream via line 130 to form a second pressurized petroleum residue-containing feedstock. The second pressurized petroleum residue-containing feedstock is received in heating unit 134 via a line 132. Heating unit 134 can be any conventional heating unit known in the art. In some embodiments, heating unit 134 can provide heat to the second pressurized petroleum residue-containing feedstock using, for example, electric heating, microwave heating, ultrasonic heating, induction heating, direct electric energy, hot oil heat exchanger or sources or electromagnetic sources. In some embodiment, heating unit 134 can be a heat exchanger to transfer heat to the second pressurized petroleum residue-containing feedstock. In some embodiments, heating unit 134 can be a furnace heater.

In some embodiments, heating unit 134 heats the second pressurized petroleum residue-containing feedstock stream to generate a heated petroleum residue-containing feedstock having a temperature ranging from about 470° C. to about 560° C. In some embodiments, heating unit 134 heats the second pressurized petroleum residue-containing feedstock to generate a heated petroleum residue-containing feedstock having a temperature ranging from about 480° C. to about 550° C.

In some embodiments, the heated petroleum residue-containing feedstock is sent to coke drum 110 via line 136-1 where it is processed with the heated one or more feedstocks comprising a solid carbon-based material in one of a semi-solid state or a melted state as discussed above (see FIG. 1A). In some embodiments, the heated petroleum residue-containing feedstock is sent to coke drum 110 via line 136-1 using valve 138 where it is processed with the one or more feedstocks comprising a solid carbon-based material as discussed above (see FIG. 1B).

In some embodiments, the heated petroleum residue-containing feedstock is sent to coke drum 118 via line 136-2 (see FIG. 1A) where it is processed with another heated one or more feedstocks comprising a solid carbon-based material in one of a semi-solid state or a melted state (not shown) in a similar manner as discussed above for coke drum 110. In some embodiments, the heated petroleum residue-containing feedstock is sent to coke drum 118 via line 136-2 using valve 137 (see FIG. 1B). Coke drum 118 can be any conventional coke drum used in refinery processing units. Coke drum 118 further includes a heating element 120 for further heating the other one or more feedstocks comprising a solid carbon-based material into one of a semi-solid state or a melted state and the heated petroleum residue-containing feedstock in coke drum 118. In some embodiments, heating element 120 is external to coke drum 118. In some embodiments, heating element 120 is internal to coke drum 118. Heating element 120 can be any of the heating elements discussed above for heating element 112. Although heating element 120 is shown as a single heating element, this is merely illustrative and any number of external and/or internal heating elements are contemplated for use in system 100.

Although it is shown that the heated petroleum residue-containing feedstock enters coke drum 118 via line 136-2, it is contemplated that heated petroleum residue-containing feedstock can enter coke drum 118 at more than one inlet and at any position of coke drum 118. For example, heated petroleum residue-containing feedstock can enter coke drum 118 at one or more of a bottom inlet, a middle inlet and a top inlet of coke drum 118.

In some embodiments, the heated one or more feedstocks comprising a solid carbon-based material in one of a semi-solid state or a melted state and the heated petroleum residue-containing feedstock can undergo one or more reactions such as, for example, pyrolysis, thermal cracking, decomposition, crystallization, mesophase formation and annealing as discussed above for coke drum 110.

In some embodiments, the temperature, residence time and pressure in coke drum 118 for pyrolyzing and thermal cracking operations can be the same as discussed above for coke drum 110.

In some embodiments, when the reaction of the heated one or more feedstocks comprising a solid carbon-based material in one of a semi-solid state or a melted state and the heated petroleum residue-containing feedstock in coke drum 118 is complete based on, for example, time of reaction, a complete reaction or that coke drum 118 is relatively full or completely full of coke, the reaction and coking cycle ends and the one or more feedstocks comprising a solid carbon-based material is transferred from coke drum 118 to another parallel coke drum, e.g., coke drum 110, to initiate another reaction and coking cycle of the one or more feedstocks comprising a solid carbon-based material and the heated petroleum residue-containing feedstock, while a coke removal process is initiated in coke drum 118.

In some embodiments, the pyrolyzing and thermal cracking operations result in a product stream comprising a gas phase comprising hydrocarbons and hydrogen and coke. When the reaction and coking cycle in coke drum 118 is complete, the reaction and coking cycle ends and the one or more feedstocks comprising a solid carbon-based material is then transferred from coke drum 118 to another parallel coke drum (not shown) to initiate its reaction and coking cycle and continuity without disruption of the coker system, while the coke removal process is initiated in the filled coke drum 118.

In some embodiments, the heated petroleum residue-containing feedstock is sent to coke drum 118 via line 136-2 where it can be subjected to coking followed by calcination to obtain needle coke in the absence of the one or more feedstocks comprising a solid carbon-based material. In an illustrative embodiment, the heated petroleum residue-containing feedstock stream is sent to coke drum 118 as known in the art and subjected to coking under coking conditions to form an intermediate coke product. In an illustrative embodiment, the coking conditions include, for example, exposing the heated petroleum residue-containing feedstock to a temperature ranging from about 490° C. to about 500° C. for a time period ranging from about 12 hours to about 36 hours.

In an illustrative embodiment, as may be combined with one or more of the preceding paragraphs, the heated petroleum residue-containing feedstock can be subjected to coking in the presence of an aromatic component such as a polymer material followed by calcination to obtain needle coke. In an illustrative embodiment, the coking conditions include, for example, exposing the heated petroleum residue-containing feedstock and the aromatic component to a temperature ranging from about 500° C. to about 525° C. for a time period ranging from about 24 hours to about 48 hours.

In an illustrative embodiment, the heated petroleum residue-containing feedstock can be co-fed with the aromatic polymer material into coke drum 118. In another embodiment, a solution of the heavy cycle oil and the aromatic polymer material are fed into coke drum 118 such as a delayed coking unit. For example, the solution is obtained by dissolving the aromatic polymer material in the heated HCO and normal coke feed stream. In an embodiment, the solution can contain from about 0.1 to about 10 wt. % of the aromatic polymer material.

In an illustrative embodiment, the aromatic polymer material includes, for example, polystyrene. Styrene is also known as ethenylbenzene, vinylbenzene, or phenylethylene. The styrene-based monomer is then polymerized (facilitated by the vinyl group) to form a homo- or copolymer. For example, the styrene-based monomer is polymerized as a homopolymer to form polystyrene.

In an illustrative embodiment, as may be combined with one or more of the preceding paragraphs, the intermediate coke product obtained from coke drum 118 can be calcinated in a calciner under calcinating conditions to obtain needle coke. Suitable calcinating conditions include, for example, a temperature ranging from about 1250° C. to about 1400° C. and for a time period ranging from about 30 to about 60 minutes.

In some embodiments, an alternative method of graphitization can be used to convert the coke without typical calcining process such as by heat treatment, catalytic graphitization, and electrochemical and chemical treatment.

In an illustrative embodiment, as may be combined with one or more of the preceding paragraphs, when coke drum 110 is receiving the one or more feedstocks comprising a solid carbon-based material from transfer device 106 for processing, valve 109 is in an open position and valves 107 and 115 are in a closed position (see FIG. 1B). While coke drum 110 is being filled with the one or more feedstocks comprising a solid carbon-based material, valve 138 is in a closed position and valve 137 is in an open position so that coke drum 118 is receiving and processing the heated petroleum residue-containing feedstock via line 136-2. In addition, valve 123 is in an open position to allow the processed heated petroleum residue-containing feedstock to flow into fractionator 116 via line 122.

In an illustrative embodiment, as may be combined with one or more of the preceding paragraphs, when coke drum 110 has received the one or more feedstocks comprising a solid carbon-based material from transfer device 106 for pre-heating the one or more feedstocks comprising a solid carbon-based material for processing, valve 109 is in a closed position, valve 107 is in an open position and valve 115 is in an open position to allow the processed one or more feedstocks comprising a solid carbon-based material to flow via line 114 into fractionator 116 with the processed heated petroleum residue-containing feedstock from coke drum 118 via line 122. While coke drum 110 is heating the one or more solid carbon-based feedstocks for processing, valve 138 is in a closed position and valve 137 is in an open position so that coke drum 118 is receiving and processing the heated petroleum residue-containing feedstock. In addition, valve 123 is in an open position to allow the processed heated petroleum residue-containing feedstock to flow into fractionator 116 via line 122.

In an illustrative embodiment, as may be combined with one or more of the preceding paragraphs, when the one or more feedstocks comprising a solid carbon-based material from transfer device 106 is heated in coke drum 110 via heating element 112, valves 107 and 109 will be in a closed position, and valve 138 is in an open position to allow the heated coke drum feed stream through valve 138 to flow the heated petroleum residue-containing feedstock into coke drum 110 for processing with the one or more feedstocks comprising a solid carbon-based material. In addition, valve 115 is in an open position to allow the processed one or more feedstocks comprising a solid carbon-based material and processed heated petroleum residue-containing feedstock to flow into fractionator 116 via line 114. While coke drum 110 is processing the one or more feedstocks comprising a solid carbon-based material and the heated petroleum residue-containing feedstock, valves 123 and 137 are in a closed position.

According to an aspect of the present disclosure, a process comprises:

receiving, in a first unheated coke drum, a feedstock comprising a solid carbon-based material, heating the first unheated coke drum and the feedstock comprising the solid carbon-based material to a first temperature to form a heated feedstock comprising the solid carbon-based material in a semi-solid state or a melted state in a first heated coke drum, and processing the heated feedstock comprising the solid carbon-based material in the semi-solid state or the melted state in the first heated coke drum with a heated petroleum residue-containing feedstock at a second temperature and under reaction conditions to convert at least a portion of the heated feedstock comprising the solid carbon-based material in the semi-solid state or the melted state to a product stream comprising a gas phase comprising hydrocarbons and hydrogen, and coke.

In one or more additional illustrative embodiments, as may be combined with the preceding paragraphs, the feedstock comprising the solid carbon-based material has a carbon content of from about 75 weight percent to about 99 weight percent.

In one or more additional illustrative embodiments, as may be combined with the preceding paragraphs, the feedstock comprising the solid carbon-based material comprises one or more polyesters, one or more polyolefins and combinations thereof.

In one or more additional illustrative embodiments, as may be combined with the preceding paragraphs, the feedstock comprising the solid carbon-based material comprises one or more of a polyethylene, a polypropylene, a polyethylene terephthalate, a polyvinyl chloride, and a polystyrene.

In one or more additional illustrative embodiments, as may be combined with the preceding paragraphs, the feedstock comprising the solid carbon-based material comprises one or more of a high-density polyethylene, a low-density polyethylene, a high molecular weight polyethylene, a low molecular weight polyethylene, polypropylene, polystyrene and combinations thereof.

In one or more additional illustrative embodiments, as may be combined with the preceding paragraphs, the feedstock comprising the solid carbon-based material comprises a solid waste plastic.

In one or more additional illustrative embodiments, as may be combined with the preceding paragraphs, the first temperature is from about 160° C. to about 320° C.

In one or more additional illustrative embodiments, as may be combined with the preceding paragraphs, the heated petroleum residue-containing feedstock comprises a petroleum residue derived from processing of crude oil in a crude unit, a heavy cycle oil of a fluid catalytic cracking unit or tar.

In one or more additional illustrative embodiments, as may be combined with the preceding paragraphs, processing the heated feedstock comprising the solid carbon-based material in the semi-solid state or the melted state in the first heated coke drum with the heated petroleum residue-containing feedstock comprises anaerobically pyrolyzing the heated feedstock comprising the solid carbon-based material in the semi-solid state or the melted state, where the second temperature is at least about 325° C.

In one or more additional illustrative embodiments, as may be combined with the preceding paragraphs, processing the heated feedstock comprising the solid carbon-based material in the semi-solid state or the melted state in the first heated coke drum with the heated petroleum residue-containing feedstock comprises anaerobically pyrolyzing the heated feedstock comprising the solid carbon-based material in the semi-solid state or the melted state, where the second temperature is from about 325° C. to about 800° C.

In one or more additional illustrative embodiments, as may be combined with the preceding paragraphs, processing the heated feedstock comprising the solid carbon-based material in the semi-solid state or the melted state in the first heated coke drum with the heated petroleum residue-containing feedstock comprises thermally cracking the heated feedstock comprising the solid carbon-based material in the semi-solid state or the melted state, where the second temperature is from about 450° C. to about 600° C.

In one or more additional illustrative embodiments, as may be combined with the preceding paragraphs, the process further comprises fractionating the product stream into one or more hydrocarbon fractions.

In one or more additional illustrative embodiments, as may be combined with the preceding paragraphs, the one or more hydrocarbon fractions from the product stream comprise one or more of $C_3$ to $C_5$ olefins and $C_6$ to $C_8$ aromatics.

In one or more additional illustrative embodiments, as may be combined with the preceding paragraphs, the one or more hydrocarbon fractions from the product stream comprise a heavy gas oil.

In one or more additional illustrative embodiments, as may be combined with the preceding paragraphs, wherein upon completion of the processing the heated feedstock comprising the solid carbon-based material in the semi-solid state or the melted state in the first heated coke drum with the heated petroleum residue-containing feedstock or the first heated coke drum is substantially full of coke, the process further comprises:

sending the feedstock comprising the solid carbon-based material to a second unheated coke drum, heating the second unheated coke drum and the feedstock comprising the solid carbon-based material to a third temperature to form another heated feedstock comprising the solid carbon-based material in a semi-solid state or a melted state in the second heated coke drum, and processing the other heated feedstock comprising the solid carbon-based material in the semi-solid state or the melted state in the second heated coke drum with the heated petroleum residue-containing feedstock at a fourth temperature and under reaction conditions to convert at least a portion of the other heated feedstock comprising the solid carbon-based material in the semi-solid state or the melted state to another product stream a gas phase comprising hydrocarbons and hydrogen, and coke.

In one or more additional illustrative embodiments, as may be combined with the preceding paragraphs, the process further comprises:

sending the other product stream comprising the gas phase comprising hydrocarbons and hydrogen to a fractionator, and fractionating the other product stream into one or more hydrocarbon fractions.

In one or more additional illustrative embodiments, as may be combined with the preceding paragraphs, wherein the first heated coke drum is substantially full of coke, the process further comprises:

subjecting the first heated coke drum to a coke recovery process.

In one or more additional illustrative embodiments, as may be combined with the preceding paragraphs, where the coke recovery process comprises calcining the coke in the first heated coke drum under calcinating conditions to obtain needle coke.

According to another aspect of the present disclosure, a system comprises:

an unheated coke drum configured to receive a feedstock comprising a solid carbon-based material, and one or more heating elements, associated with the unheated coke drum, and configured to heat the unheated coke drum and the feedstock comprising the solid carbon-based material to a first temperature to form a heated feedstock comprising the solid carbon-based material in a semi-solid state or a melted state in a heated coke drum, wherein the heated coke drum is configured to process the heated feedstock comprising the solid carbon-based material in the semi-solid state or the melted state with a heated petroleum residue-containing feedstock at a second temperature and under reaction conditions to convert at least a portion of the heated feedstock comprising the solid carbon-based material in the semi-solid state or the melted state to a product stream comprising a gas phase comprising hydrocarbons and hydrogen, and coke.

In one or more additional illustrative embodiments, as may be combined with the preceding paragraphs, the system further comprises:

a fractionator configured to fractionate the product stream into one or more hydrocarbon fractions, wherein at least one of the one or more hydrocarbon fractions comprises a heavy bottoms stream.

In one or more additional illustrative embodiments, as may be combined with the preceding paragraphs, the system further comprises:

another unheated coke drum configured to receive the feedstock comprising a solid carbon-based material, and one or more other heating elements, associated with the other unheated coke drum, and configured to heat the other unheated coke drum and the feedstock comprising the solid carbon-based material to a third temperature to form another heated feedstock comprising the solid carbon-based material in a semi-solid state or a melted state in another heated coke drum, wherein the other heated coke drum is configured to process the other heated feedstock comprising the solid carbon-based material in the semi-solid state or the melted state with another heated petroleum residue-containing feedstock at a fourth temperature and under reaction conditions to convert at least a portion of the other heated feedstock comprising the solid carbon-based material in the semi-solid state or the melted state to another product stream comprising a gas phase comprising hydrocarbons and hydrogen, and coke.

Various features disclosed herein are, for brevity, described in the context of a single embodiment, but may also be provided separately or in any suitable sub-combination. All combinations of the embodiments are specifically embraced by the illustrative embodiments disclosed herein just as if each and every combination was individually and explicitly disclosed. In addition, all sub-combinations listed in the embodiments describing such variables are also specifically embraced by the present compositions and are disclosed herein just as if each and every such sub-combination was individually and explicitly disclosed herein.

It will be understood that various modifications may be made to the embodiments disclosed herein. Therefore the above description should not be construed as limiting, but merely as exemplifications of preferred embodiments. For example, the functions described above and implemented as the best mode for operating the present invention are for illustration purposes only. Other arrangements and methods may be implemented by those skilled in the art without departing from the scope and spirit of this invention. Moreover, those skilled in the art will envision other modifications within the scope and spirit of the claims appended hereto.

What is claimed is:

1. A process, comprising:

receiving, in a first unheated coke drum, a feedstock comprising a solid carbon-based material in an unheated state;

after a sufficient amount of the feedstock comprising the solid carbon-based material is received in the first unheated coke drum, heating the first unheated coke drum and the feedstock comprising the solid carbon-based material in the first unheated coke drum to a first temperature to form a first heated coke drum containing a heated feedstock comprising the solid carbon-based material in a semi-solid state or a melted state in a first heated coke drum; and flowing a heated petroleum residue-containing feedstock into the first heated coke drum at a second temperature for processing the heated feedstock comprising the solid carbon-based material in the semi-solid state or the melted state under reaction conditions to convert at least a portion of the heated feedstock comprising the solid carbon-based material in the semi-solid state or the melted state to a product stream comprising a gas phase comprising hydrocarbons and hydrogen, and coke.

2. The process according to claim 1, wherein the feedstock comprising the solid carbon-based material has a carbon content of from about 75 weight percent to about 99 weight percent.

3. The process according to claim 1, wherein the feedstock comprising the solid carbon-based material comprises one or more polyesters, one or more polyolefins and combinations thereof.

4. The process according to claim 1, wherein the feedstock comprising the solid carbon-based material comprises one or more of a polyethylene, a polypropylene, a polyethylene terephthalate, a polyvinyl chloride, and a polystyrene.

5. The process according to claim 1, wherein the feedstock comprising the solid carbon-based material comprises one or more of a high-density polyethylene, a low-density polyethylene, a high molecular weight polyethylene, a low molecular weight polyethylene, polypropylene, polystyrene and combinations thereof.

6. The process according to claim 1, wherein the feedstock comprising the solid carbon-based material comprises a solid waste plastic.

7. The process according to claim 1, wherein the first temperature is from about 160° C. to about 320° C.

8. The process according to claim 1, wherein the heated petroleum residue-containing feedstock comprises a petroleum residue derived from processing of crude oil in a crude unit, a heavy cycle oil of a fluid catalytic cracking unit or tar.

9. The process according to claim 1, wherein processing the heated feedstock comprising the solid carbon-based material in the semi-solid state or the melted state in the first heated coke drum with the heated petroleum residue-containing feedstock comprises anaerobically pyrolyzing the heated feedstock comprising the solid carbon-based material in the semi-solid state or the melted state, where the second temperature is at least about 325° C.

10. The process according to claim 1, wherein processing the heated feedstock comprising the solid carbon-based material in the semi-solid state or the melted state in the first heated coke drum with the heated petroleum residue-containing feedstock comprises anaerobically pyrolyzing the heated feedstock comprising the solid carbon-based material in the semi-solid state or the melted state, where the second temperature is from about 325° C. to about 800° C.

11. The process according to claim 1, wherein processing the heated feedstock comprising the solid carbon-based material in the semi-solid state or the melted state in the first heated coke drum with the heated petroleum residue-containing feedstock comprises thermally cracking the heated feedstock comprising the solid carbon-based material in the semi-solid state or the melted state, where the second temperature is from about 450° C. to about 600° C.

12. The process according to claim 1, further comprising fractionating the product stream into one or more hydrocarbon fractions.

13. The process according to claim 12, wherein the one or more hydrocarbon fractions from the product stream comprise one or more of $C_3$ to $C_5$ olefins and $C_0$ to $C_8$ aromatics.

14. The process according to claim 12, wherein the one or more hydrocarbon fractions from the product stream comprise a heavy gas oil.

15. The process according to claim 1, wherein upon completion of the processing the heated feedstock comprising the solid carbon-based material in the semi-solid state or the melted state in the first heated coke drum with the heated petroleum residue-containing feedstock or the first heated coke drum is substantially full of coke, the process further comprises:

sending the feedstock comprising the solid carbon-based material in the unheated state to a second unheated coke drum;

after a sufficient amount of the feedstock comprising the solid carbon-based material is received in the second unheated coke drum, heating the second unheated coke drum and the feedstock comprising the solid carbon-based material to a third temperature to form another heated feedstock comprising the solid carbon-based material in a semi-solid state or a melted state in a second heated coke drum; and flowing the heated petroleum residue-containing feedstock into the second heated coke drum at a fourth temperature for processing the other heated feedstock comprising the solid carbon-based material in the semi-solid state or the melted state under reaction conditions to convert at least a portion of the other heated feedstock comprising the solid carbon-based material in the semi-solid state or the melted state to another product stream comprising a gas phase comprising hydrocarbons and hydrogen, and coke.

16. The process according to claim 15, further comprising:

sending the other product stream comprising the gas phase comprising hydrocarbons and hydrogen to a fractionator; and fractionating the other product stream into one or more hydrocarbon fractions.

17. The process according to claim 15, wherein the first heated coke drum is substantially full of coke, the process further comprises:

subjecting the first heated coke drum to a coke recovery process.

18. The process according to claim 17, wherein the coke recovery process comprises calcining the coke in the first heated coke drum under calcinating conditions to obtain needle coke.

19. The process according to claim 1, wherein the feedstock comprising the solid carbon-based material is received in the first unheated coke drum from a storage unit.

20. The process according to claim 1, wherein a sufficient amount comprises about 10% to about 50% of the first unheated coke drum being filled with the feedstock comprising the solid carbon-based material.

* * * * *